US010527981B2

(12) United States Patent
Naitoh et al.

(10) Patent No.: US 10,527,981 B2
(45) Date of Patent: Jan. 7, 2020

(54) FIXING DEVICE AND IMAGE FORMING APPARATUS INCORPORATING SAME

(71) Applicants: Yutaka Naitoh, Kanagawa (JP); Hiroshi Yoshinaga, Chiba (JP); Daisuke Inoue, Tokyo (JP); Natsuki Watanabe, Kanagawa (JP); Takahiro Imada, Kanagawa (JP)

(72) Inventors: Yutaka Naitoh, Kanagawa (JP); Hiroshi Yoshinaga, Chiba (JP); Daisuke Inoue, Tokyo (JP); Natsuki Watanabe, Kanagawa (JP); Takahiro Imada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/398,896

(22) Filed: Apr. 30, 2019

(65) Prior Publication Data

US 2019/0377286 A1 Dec. 12, 2019

(30) Foreign Application Priority Data

Jun. 7, 2018 (JP) ..... 2018-109394

(51) Int. Cl.
*G03G 15/20* (2006.01)
*G03G 21/16* (2006.01)

(52) U.S. Cl.
CPC ..... *G03G 15/2028* (2013.01); *G03G 15/2017* (2013.01); *G03G 15/2025* (2013.01);
(Continued)

(58) Field of Classification Search
CPC ..... G03G 15/2025; G03G 15/2028; G03G 15/2017; G03G 21/1685;
(Continued)

(56) References Cited

U.S. PATENT DOCUMENTS

2006/0083567 A1* 4/2006 Ito ..... G03G 15/206 399/400
2010/0202809 A1 8/2010 Shinshi et al.
(Continued)

FOREIGN PATENT DOCUMENTS

JP 2004-206105 7/2004
JP 2010-181821 8/2010
(Continued)

*Primary Examiner* — Joseph S Wong
(74) *Attorney, Agent, or Firm* — Oblon, McClelland, Maier & Neustadt, L.L.P.

(57) ABSTRACT

A fixing device includes a rotatable pressing roller, a fixing rotator to rotate in contact with the pressing roller, a nip formation pad, and a slide sheet disposed between the nip formation pad and the fixing rotator. The slide sheet includes a base material layer made of a woven fabric of spun yarn. In the base material layer, a distance between adjacent spun yarns is equal to or less than 0.4 times a width of the spun yarn in a cross-section of the slide sheet in a direction of slide movement of the fixing rotator, and, in a cross-section of the slide sheet in a longitudinal direction of the slide sheet and a direction perpendicular to the slide movement of the fixing rotator, a thickness of the spun yarn is equal to or greater than 0.2 times a width of the spun yarn.

8 Claims, 6 Drawing Sheets

(52) U.S. Cl.
CPC . *G03G 21/1685* (2013.01); *G03G 2215/2003* (2013.01); *G03G 2215/2025* (2013.01); *G03G 2215/2029* (2013.01); *G03G 2215/2035* (2013.01); *G03G 2215/2038* (2013.01)

(58) Field of Classification Search
CPC ... G03G 2215/2003; G03G 2215/2025; G03G 2215/2029; G03G 2215/2035; G03G 2215/2038
See application file for complete search history.

(56) References Cited

U.S. PATENT DOCUMENTS

| | | | | |
|---|---|---|---|---|
| 2013/0195524 | A1 | 8/2013 | Ishii et al. | |
| 2013/0266354 | A1* | 10/2013 | Nishida | G03G 15/2053 399/329 |
| 2017/0255147 | A1 | 9/2017 | Seki et al. | |
| 2017/0261900 | A1 | 9/2017 | Sawada et al. | |
| 2017/0285542 | A1 | 10/2017 | Hase et al. | |
| 2017/0364000 | A1 | 12/2017 | Seki et al. | |
| 2018/0011432 | A1 | 1/2018 | Yoshinaga et al. | |
| 2018/0017910 | A1 | 1/2018 | Sawada et al. | |
| 2018/0059587 | A1 | 3/2018 | Sawada et al. | |
| 2018/0120741 | A1 | 5/2018 | Yoshinaga et al. | |
| 2018/0157198 | A1 | 6/2018 | Seto et al. | |
| 2018/0173138 | A1 | 6/2018 | Seki et al. | |
| 2018/0267449 | A1 | 9/2018 | Naitoh et al. | |
| 2018/0284669 | A1 | 10/2018 | Fujimoto et al. | |
| 2018/0329342 | A1 | 11/2018 | Seshita et al. | |
| 2018/0335733 | A1 | 11/2018 | Matsuda et al. | |
| 2018/0348680 | A1 | 12/2018 | Fujimoto et al. | |
| 2018/0356754 | A1 | 12/2018 | Yoshinaga et al. | |
| 2018/0364625 | A1* | 12/2018 | Yagi | G03G 15/2053 |

FOREIGN PATENT DOCUMENTS

| | | |
|---|---|---|
| JP | 2010-266802 | 11/2010 |
| JP | 2013-152397 | 8/2013 |
| JP | 2013-214039 | 10/2013 |
| JP | 2017-107154 | 6/2017 |

* cited by examiner

○: NO WRINKLES

△: MINOR WRINKLES OCCUR

×: WRINKLES OCCUR

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119 to Japanese Patent Application No. 2018-109394, filed on Jun. 7, 2018 in the Japanese Patent Office, the entire disclosure of which is hereby incorporated by reference herein.

BACKGROUND

Technical Field

Embodiments of the present disclosure generally relate to a fixing device and an image forming apparatus incorporating the fixing device.

Background Art

A fixing device is known that includes a pressing roller, a fixing belt that contacts the outer surface of the pressing roller and is driven to rotate, and a nip formation pad disposed inside of the fixing belt to form a nip, which is called a belt sliding type fixing device. In such a fixing device, a technology is known that reduces sliding friction of the rotating fixing belt by using a low-friction sheet (slide sheet) held by the nip formation pad.

In the conventional belt sliding type fixing device, since the low-friction sheet made of a glass cloth base material has a smaller coefficient of linear expansion than the fixing belt made of a resin base material such as polyimide, the low-friction sheet does not exhibit thermal expansion when the fixing belt expands in a longitudinal direction by the thermal expansion. Therefore, heat shrinkage of the fixing belt after the fixing device cools generates a force that moves the low-friction sheet toward a central portion in the longitudinal direction. Repeated heating and cooling in the fixing device may generate wrinkles in the central portion of the low friction sheet.

SUMMARY

This specification describes an improved fixing device that includes a rotatable pressing roller, a fixing rotator disposed to rotate in contact with the pressing roller, a nip formation pad disposed inside the fixing rotator to form a nip with pressure from the pressing roller to fix an image on a recording medium, and a slide sheet disposed between the nip formation pad and the fixing rotator. The slide sheet includes a base material layer made of a woven fabric of spun yarn. In the base material layer, a distance between adjacent spun yarns is equal to or less than 0.4 times a width of the spun yarn in a cross-section of the slide sheet in a direction of slide movement of the fixing rotator, and, in a cross-section of the slide sheet in a longitudinal direction of the slide sheet and a direction perpendicular to the slide movement of the fixing rotator, a thickness of the spun yarn is equal to or greater than 0.2 times an width of the spun yarn.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
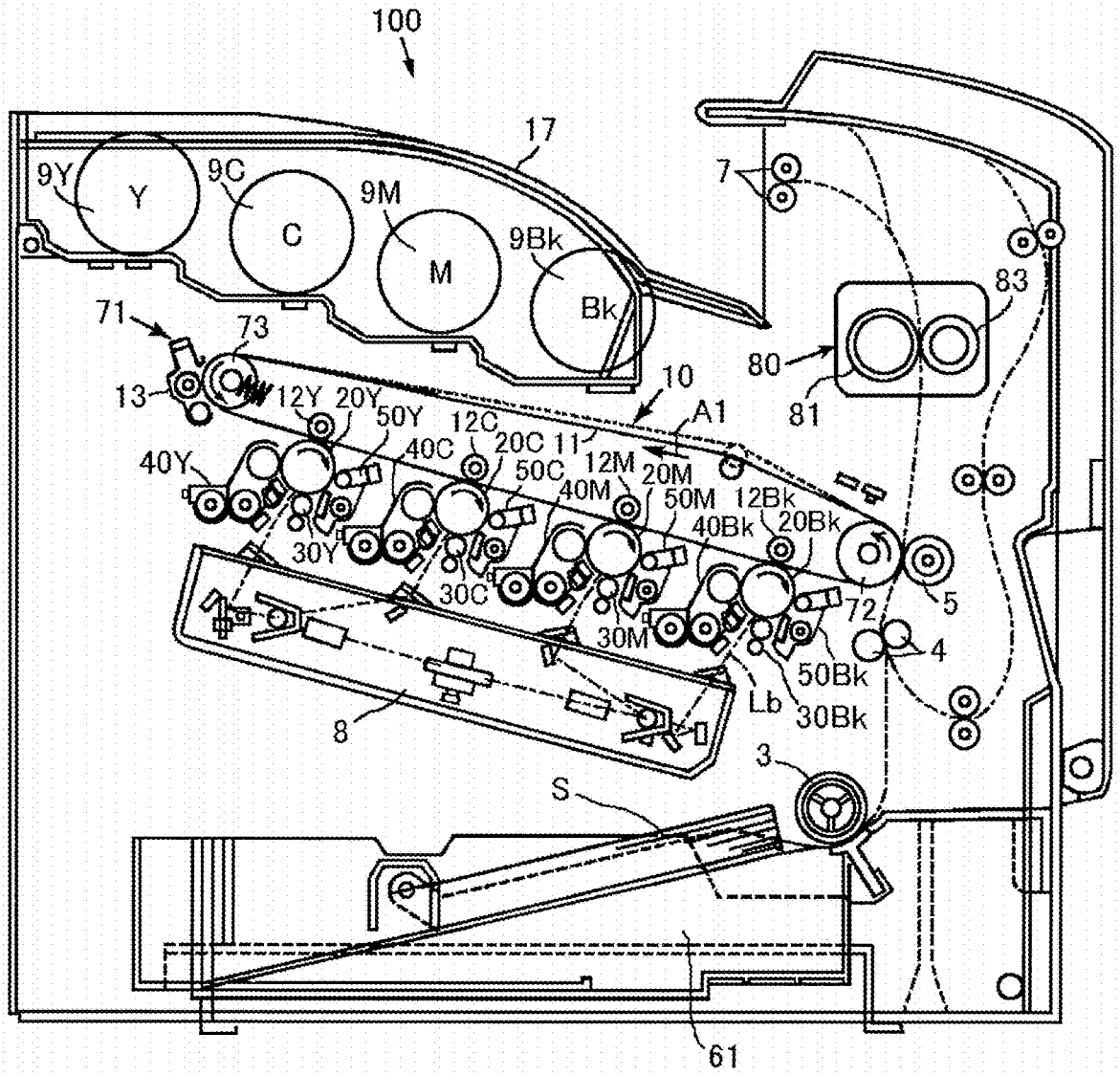
FIG. 1 is a schematic diagram illustrating an image forming apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

FIG. 1 is a schematic diagram illustrating an image forming apparatus according to embodiments of the present disclosure.

The image forming apparatus 100 includes a fixing device 80 of the present disclosure to fix a toner image on a recording sheet S serving as a recording medium on which the toner image is transferred. The image forming apparatus 100 is not limited to a printer that uses a tandem system illustrated in FIG. 1. Alternatively, adding the printer, the image forming apparatus 100 may be a copier and a facsimile machine.

The image forming apparatus 100 illustrated in FIG. 1 employs a tandem structure in which four photoconductor drums 20Y, 20C, 20M, and 20Bk serving as image bearers that bear yellow, cyan, magenta, and black toner images in separation colors, respectively, are aligned.

The photoconductor drums 20Y, 20C, 20M, and 20Bk are aligned in this order from an upstream side in a direction of arrow A1 in FIG. 1. The photoconductor drums 20Y, 20C, 20M, and 20Bk are incorporated in four image forming stations that form the yellow, cyan, magenta, and black toner images, respectively.

Each of the yellow, cyan, magenta, and black visible images formed on the photoconductor drums 20Y, 20C, 20M, and 20Bk, respectively, is transferred onto an intermediate transferor 11 (hereinafter called a transfer belt 11) that is an endless belt opposite the photoconductor drums 20Y, 20C, 20M, and 20Bk and movable in the direction of the arrow A1 and superimposed on the transfer belt 11, in a primary transfer process. Thereafter, the yellow, cyan, magenta, and black toner images superimposed on the transfer belt 11 are secondarily transferred onto a recording medium S (e.g., a recording sheet and a transfer sheet) collectively in a secondary transfer process.

Each of the photoconductor drums 20Y, 20C, 20M, and 20Bk is surrounded by image forming components that form the yellow, cyan, magenta, and black toner images on the photoconductor drums 20Y, 20C, 20M, and 20Bk as the photoconductor drums 20Y, 20C, 20M, and 20Bk rotate clockwise in FIG. 1.

For example, the photoconductor drum 20Bk on which the black toner image is formed is surrounded by a charger 30Bk, a developing device 40Bk, a primary transfer roller 12Bk, and a cleaning device 50Bk in a rotation direction of the photoconductor drum 20Bk, which perform image formation processing. Similarly, the image forming apparatus 100 includes chargers 30Y, 30C, and 30M, developing devices 40Y, 40C, and 40M, primary transfer rollers 12Y, 12C, and 12M, and cleaning devices 50Y, 50C, and 50M. After the charger 30Bk charges the photoconductor drum 20Bk, an optical writing device 8 writes an electrostatic latent image on the photoconductor drum 20Bk.

As the transfer belt 11 rotates in the direction A1, the yellow, cyan, magenta, and black toner images formed on the photoconductor drums 20Y, 20C, 20M, and 20Bk, respectively, are primarily transferred successively onto the transfer belt 11, thus being superimposed on the same position on the transfer belt 11. For example, the primary transfer rollers 12Y, 12C, 12M, and 12Bk disposed opposite the photoconductor drums 20Y, 20C, 20M, and 20Bk via the transfer belt 11, respectively, and applied with an electric voltage primarily transfer the yellow, cyan, magenta, and black toner images formed on the photoconductor drums 20Y, 20C, 20M, and 20Bk at different times from the upstream photoconductor drum 20Y to the downstream photoconductor drum 20Bk in the direction A1.

The image forming apparatus 100 includes the four image forming stations, a transfer belt unit 10, a secondary transfer roller 5, a belt cleaner 13, and the optical writing device 8. The transfer belt unit 10 includes the transfer belt 11 and the primary transfer rollers 12Y, 12C, 12M, and 12Bk that are disposed above and opposite each of the photoconductor drums 20Y, 20C, 20M, and 20Bk. The secondary transfer roller 5 serves as a transferor disposed opposite the transfer belt 11 and driven and rotated in accordance with rotation of the transfer belt 11. The belt cleaner 13 is disposed opposite the transfer belt 11 to clean the transfer belt 11. The optical writing device 8 is disposed below and opposite the four image forming stations.

The optical writing device 8 includes a semiconductor laser serving as a light source, a coupling lens, an fθ lens, a toroidal lens, a deflection mirror, and a polygon mirror serving as a deflector. The optical writing device 8 emits light beams Lb, corresponding to the yellow, cyan, magenta, and black toner images to be formed on the photoconductor drums 20Y, 20C, 20M, and 20Bk thereon, forming electrostatic latent images on the photoconductor drums 20Y, 20C, 20M, and 20Bk, respectively.

The image forming apparatus 100 further includes a sheet feeder 61 and a registration roller pair 4. The sheet feeder 61 includes a paper tray that loads a plurality of recording media S to be conveyed one by one to a secondary transfer nip formed between the transfer belt 11 and the secondary transfer roller 5. The registration roller pair 4 feeds the recording medium S conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 100 further includes a sensor for detecting whether a leading edge of the recording medium S reaches the registration roller pair 4.

The image forming apparatus 100 further includes a fixing device 80 according to the present disclosure, an ejection roller pair 7, an output tray 17, and toner bottles 9Y, 9C, 9M, and 9Bk. The fixing device 80 fixes on the recording medium S a color toner image formed by the yellow, cyan, magenta, and black toner images secondarily transferred from the transfer belt 11 onto the recording medium S. The ejection roller pair 7 ejects the recording medium S bearing the fixed toner image to an outside of the image forming apparatus 100. The output tray 17 is disposed atop the image forming apparatus 100 and stacks the recording medium S ejected by the ejection roller pair 7. The toner bottles 9Y, 9C, 9M, and 9K are disposed below the output tray 17 and replenished with fresh yellow, cyan, magenta, and black toners, respectively.

The transfer belt unit 10 includes a driving roller 72 and a driven roller 73 around which the transfer belt 11 is looped, in addition to the transfer belt 11 and the primary transfer rollers 12Y, 12C, 12M, and 12Bk.

Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12Bk, the secondary transfer roller 5, and the belt cleaner 13 together constitute a transfer device 71.

The sheet feeder 61 is disposed in a lower portion of the image forming apparatus 100 and includes a feed roller 3 that contacts an upper side of an uppermost recording medium S of the plurality of recording media S loaded on the paper tray of the sheet feeder 61. As the feed roller 3 is driven and rotated counterclockwise in FIG. 1, the feed roller 3 feeds the uppermost recording medium S to the registration roller pair 4.

The cleaner 13 disposed in the transfer device 71 includes a cleaning brush and a cleaning blade that are disposed opposite the transfer belt 11 to contact the transfer belt 11. The cleaning brush and the cleaning blade scrape a foreign substance such as residual toner not transferred onto the sheet and therefore remaining on the transfer belt 11 off the transfer belt 11, thus cleaning the outer circumferential surface of the transfer belt 11. The cleaner 13 further includes a waste toner conveyer to convey the residual toner removed from the transfer belt 11.

Figure 2:
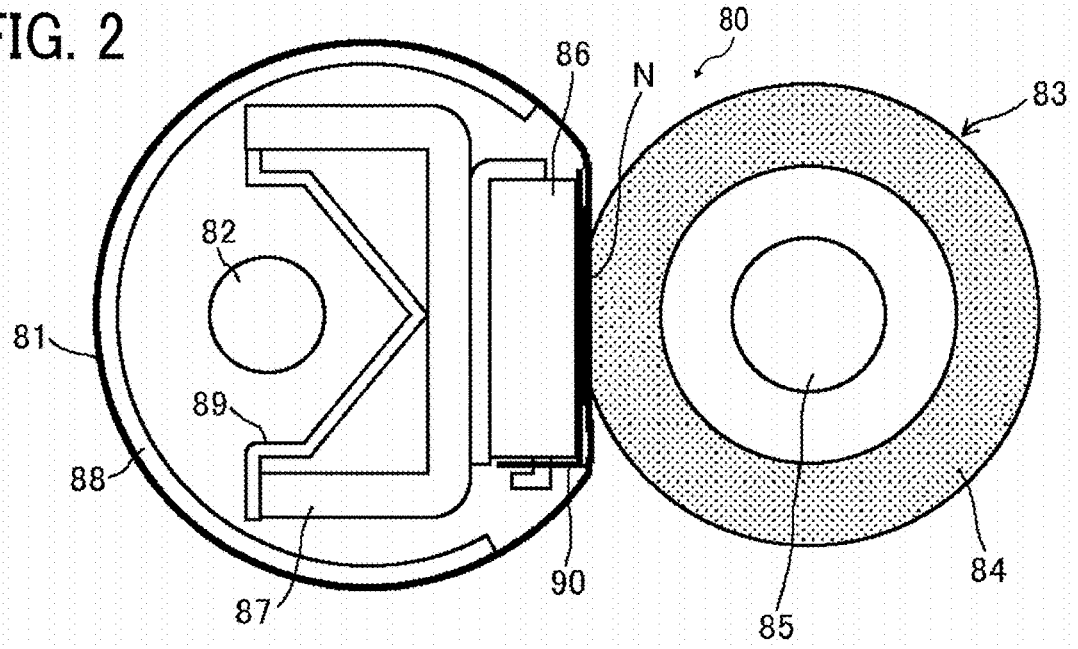
FIG. 2 is a schematic sectional view of a fixing device incorporated in the image forming apparatus of FIG. 1.

With reference to FIG. 2, a description is provided of a construction of the fixing device 80 disposed in the image forming apparatus 100.

The fixing device 80 according to the present embodiment includes a rotatable pressing roller 83 as a pressing member, a fixing belt 81 that is a fixing rotator which rotates in contact with the pressing roller 83 and is driven to rotate, a nip formation pad 86 that contacts and presses against the pressing roller 83 via the fixing belt 81 to form a nip N, and a slide sheet 90 that is a low friction member disposed between the nip formation pad 86 and the fixing belt 81. The fixing device 80 leads the image on the recording medium S to pass through the nip N and fix the image.

As illustrated in FIG. 2, the fixing device 80 includes the pressing roller 83 that is a rotatable roller, the fixing belt 81 that is an endless belt, and a heat source 82 such as a halogen heater that directly heats an inner circumferential surface of the fixing belt 81.

In the present example, the fixing nip N is flat as illustrated in FIG. 2. Alternatively, the fixing device 80 may be configured such that the fixing nip N is given a concave shape or another shape. If the fixing nip N defines the recess in the fixing belt 81, the recessed fixing nip N directs the leading edge of the sheet S toward the pressing roller 83 as the sheet S is ejected from the fixing nip N, facilitating separation of the sheet S from the fixing belt 81 and suppressing paper jam.

The fixing belt 81 is an endless belt or film made of a metal material, such as nickel or stainless steel, or a resin material, such as polyimide. A surface layer of the fixing belt 81 includes a release layer such as a layer made of Tetra fluoro ethylene-perfluoro Alkylvinyl ether copolymer (PFA) or Poly Tetra Fluoro Ethylene (PTFE) to facilitate separation of toner of the toner image on the sheet S from the fixing belt 81. An elastic layer may be formed by silicone rubber or the like between the base layer and the layer made of PFA or PTFE in the belt. The fixing belt 81 that does not incorporate the elastic layer made of silicone rubber has a small thermal capacity that improves fixing property in that it is capable of being heated quickly to a desired fixing temperature at which the toner image is fixed on the sheet S. However, as the fixing belt 81 presses the unfixed toner image on the sheet S, slight surface asperities in the fixing belt 81 are transferred onto the toner image on the sheet S, resulting in variation in gloss of the solid toner image that may appear as an orange peel image on the sheet S. To eliminate uneven gloss, the elastic layer made of silicone rubber has a thickness not smaller than 100 μm. Deformation of the elastic layer made of silicone rubber absorbs slight surface asperities in the fixing belt 81 and reduces the orange-peel effect.

A support such as a stay 87 that is disposed inside the loop formed by the fixing belt 81 to support the nip N prevents the nip formation pad 86 that receives pressure from the pressing roller 83 from bending and gives an even nip width in an axial direction of the fixing belt 81.

A holder (e.g., a flange) 88 holds each end portion of the stay 87, thus secures the stay 87 at a predetermined position. The reflector 89 is interposed between the heat source 82 and the stay 87. The reflector 89 reflects the heat radiating from the heat source 82 toward the inner circumferential surface of the fixing belt 81, thereby preventing the stay 87 from being heated unnecessarily by the heat source 82 and reducing waste of energy. Alternatively, instead of the reflector 89, the surface of the stay 87 facing the heat source 82 may be insulated or given a mirror finish to reflect the heat radiating from the heat source 82 toward the fixing belt 81. A halogen heater serves as the heat source 82 in the present embodiment. Alternatively, the heat source 82 may be an induction heater (IH), a resistive heat generator, a carbon heater, or the like.

The pressing roller 83 includes a cored bar 85, an elastic layer 84 coating the cored bar 85 and made of rubber, and a release layer coating the elastic layer and made of PFA or PTFE to facilitate separation of the sheet P from the pressing roller 83. The cored bar 85 is a rotatable member disposed at an axis of the pressing roller 83.

As a driving force generated by a driver such as a motor disposed inside the image forming apparatus 100 is transmitted to the pressing roller 83 through a gear train, the pressing roller 83 rotates.

A spring or the like presses the pressing roller 83 against the nip formation pad 86 via the fixing belt 81. As the spring presses and deforms the elastic layer 84 of the pressing roller 83, the pressing roller 83 produces the fixing nip N having a predetermined nip width.

Alternatively, the pressing roller 83 may be a hollow roller that accommodates the heat source 82 such as a halogen heater therewithin. The elastic layer 84 may be made of solid rubber. Alternatively, if no heater such as the heat source 82 is situated inside the pressing roller 83, the elastic layer 84 may be made of sponge rubber. The sponge rubber is preferable because the sponge rubber has an increased insulation that draws less heat from the fixing belt 81.

As the pressing roller 83 rotates, the fixing belt 81 rotates in accordance with rotation of the pressing roller 83 by friction therebetween.

In the present embodiment illustrated in FIG. 2, the driver disposed inside the image forming apparatus 100 rotates the pressing roller 83, and the driving force from the driver is transmitted to the fixing belt 81 at the nip N and rotates the fixing belt 81. At the fixing nip N, the fixing belt 81 rotates while being sandwiched between the pressing roller 83 and the nip formation pad 86. On the other hand, at a location other than the nip N, the fixing belt 81 rotates while being guided by the holder 88 disposed at each end of the fixing belt 81 in the axial direction thereof.

The fixing device 80 having the above-described configuration speeds warm-up and is inexpensive.

The fixing device according to the embodiments of the present disclosure is not limited to the fixing device 80 illustrated in FIG. 2. Alternatively, for example, the fixing device may include a fixing roller as a fixing member and an endless belt as a pressure member. Even in this case, the sliding sheet is disposed inside the endless belt and provided between the nip formation pad and the endless belt.

Figure 3:
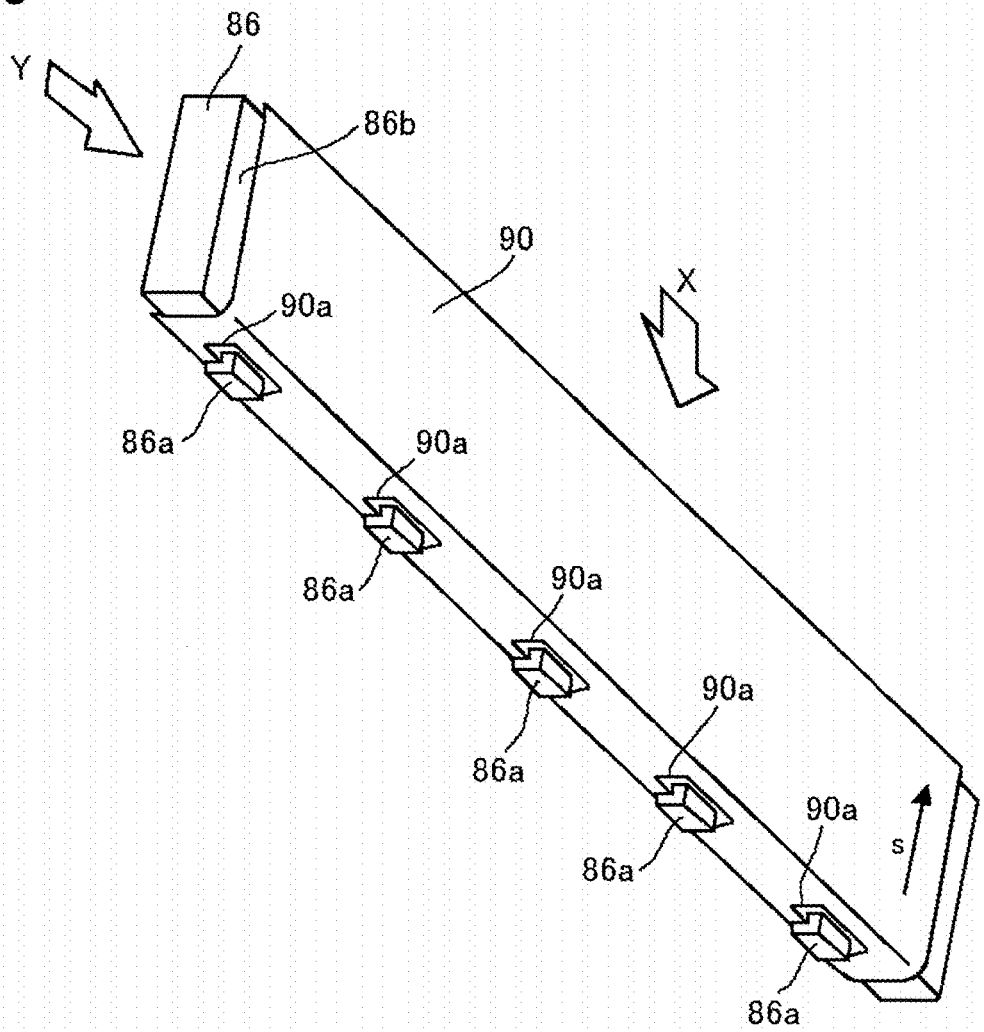
FIG. 3 is a schematic perspective view illustrating a slide sheet according to a first embodiment.
Figure 4A:
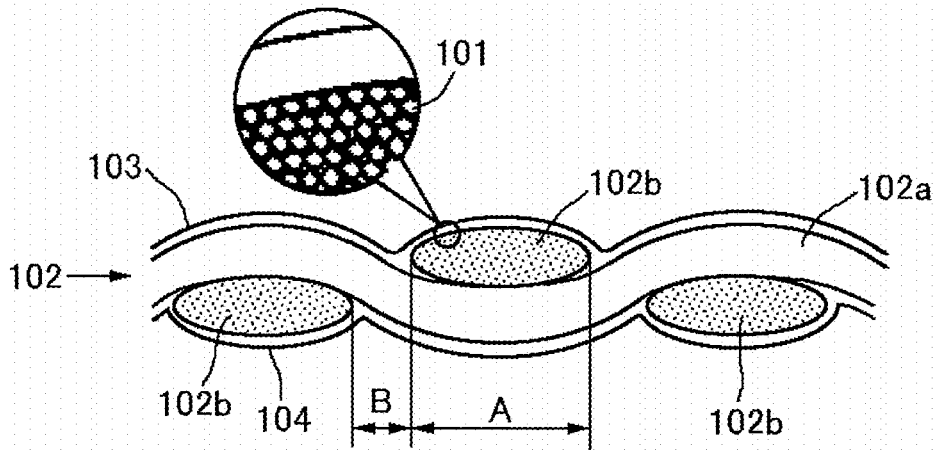
FIG. 4A is a schematic cross-sectional view of the slide sheet as viewed in the direction of arrow X in FIG. 3.
Figure 4B:
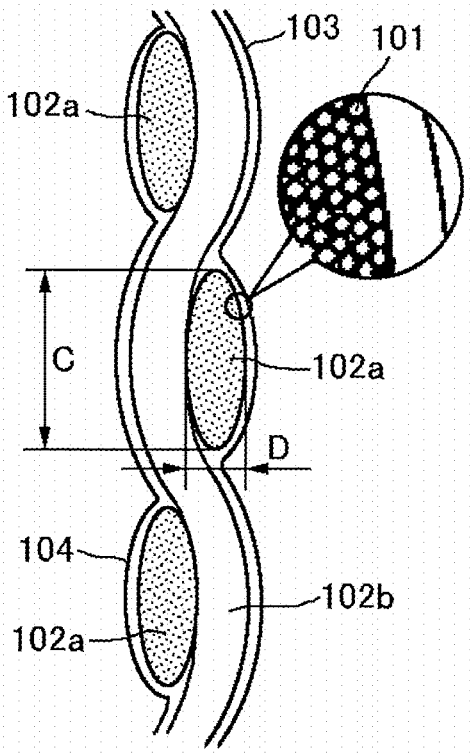
FIG. 4B is a schematic cross-sectional view of the slide sheet as viewed in the direction of arrow Y in FIG. 3.

FIG. 3 is a schematic perspective view illustrating a slide sheet according to a first embodiment. FIG. 4A is a schematic cross-sectional view of the slide sheet as viewed in the direction of arrow X in FIG. 3, and FIG. 4B is a schematic cross-sectional view of the slide sheet as viewed in the direction of arrow Yin FIG. 3.

As illustrated in FIG. 3, the nip formation pad 86 according to the present embodiment has a plurality of projections 86*a* on the upstream side in the rotation direction and sliding direction of the fixing belt 81 indicated by arrow s in FIG. 3. The projection 86*a* has an L-shaped cross-section that extends downward from a bottom of the nip formation pad 86 and then bends in an opposite direction to the pressing roller 83. The lower portion of the slide sheet 90 has a plurality of holes 90*a* provided at positions corresponding to the projections 86*a*, and the projections 86*a* are inserted into the holes 90*a*. Then the slide sheet 90 is hooked on the L-shaped projections 86*a*. Such simple holding member holds the slide sheet 90 that contacts a side surface 86*b* of the nip formation pad 86 to form the nip N.

Although the nip formation pad 86 has five projections 86*a* in FIG. 3, the projections 86*a* are not limited to five, and a designer may appropriately arrange the necessary number of projections 86*a*. Such simple configuration holding the slide sheet 90 is due to high rigidity of the slide sheet 90 and a structure of the slide sheet 90 that can withstand external forces.

FIG. 4A is a cross-sectional view of the slide sheet 90 as viewed in the direction of arrow X in FIG. 3.

In the present embodiment, one yarn is formed by spinning several tens to several hundreds of glass fibers 101 without knitting fibers, that is, by bundling glass fibers 101. The slide sheet 90 includes a base material layer 102 formed by braiding a weft thread 102*a* and a warp thread 102*b*, a surface layer 103 made of a material such as PTFE to reduce sliding friction, and a back layer 104 disposed to reinforce the slide sheet 90 and prevent the slide sheet 90 from warping. The base material layer 102 of the slide sheet 90 is made of a woven fabric, and in particular is formed by weaving a spun yarn obtained by spinning fibers without knitting. Using spun yarn instead of knitting yarn forms a high-density, high-strength base material layer 102, and wrinkles are less likely to occur as a result.

As illustrated in a partial enlarged view of FIG. 4A, the spun yarn is formed by spinning a plurality of thin fibers that are, in this example, glass fibers 101. As a result, since the spun yarn is formed of a collection of thin fibers, weaving can produce the flexible slide sheet 90 which can easily conform to a complicated nip shape having curvature. When the base material layer 102 is impregnated with another resin material, the resin material is easily impregnated because there are many spaces between the fibers of the spun yarn.

The aforementioned wrinkles of the slide sheet 90 are generated by buckling of the weft thread 102*a* at a position of the interval B between the adjacent warp threads 102*b* due to the compression force in a horizontal direction of the warp threads 102*b* in FIG. 4A. Therefore, in the present embodiment, the ratio (B/A) of the distance B between the adjacent warp threads 102*b* to the width A of the warp thread 102*b* is configured to be equal to or less than a predetermined ratio, which can reduce buckling of the weft thread 102*a*.

FIG. 4B is a cross-sectional view of the slide sheet 90 as viewed in the direction of arrow Y in FIG. 3.

In FIG. 4B, since the compression force applied to the weft thread 102*a* acts in a front direction, that is, a direction perpendicular to the sheet in FIG. 4B, the greater the cross-sectional secondary radius of the weft thread 102*a*, the more the weft thread resists the compression force and the slide sheet 90 is less wrinkled. That is, if the ratio (D/C) of the thickness D of the weft thread 102*a* to the width C of the weft thread 102*a* is a predetermined ratio or more, the slide sheet 90 is less wrinkled.

Figure 5:
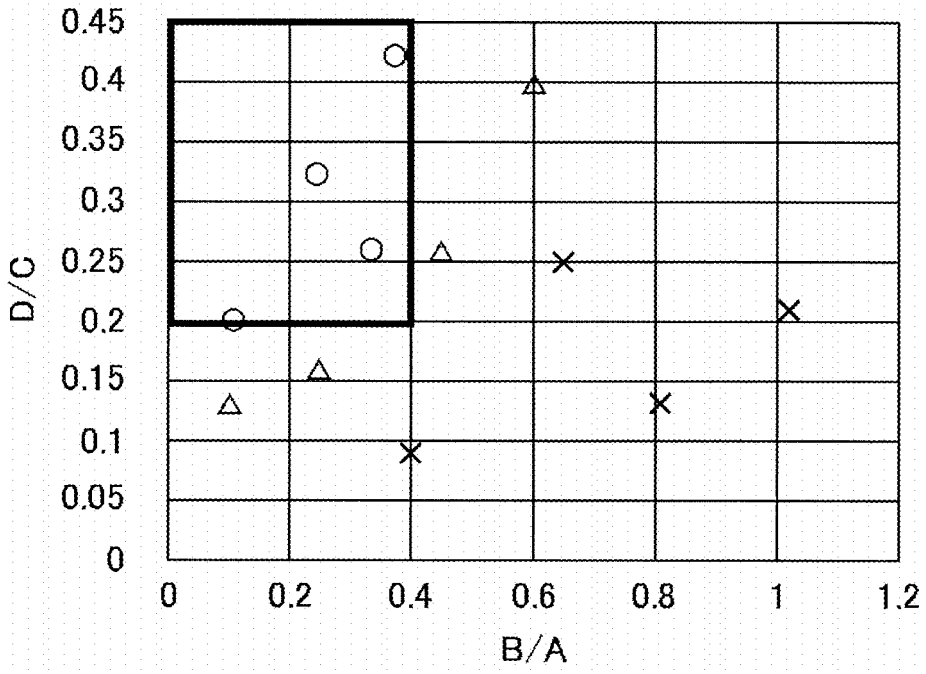
FIG. 5 is a graph illustrating experimental results on various ratios of B/A and D/C.

FIG. 5 is a graph illustrating experimental results on various ratios of B/A and D/C.

The inventors of the present disclosure conducted experiments to examine an occurrence of the wrinkles in the slide sheet 90 for various values of the above-described factors A, B, C, and D and obtained experimental results illustrated in FIG. 5. According to the experimental results, when the distance B between adjacent warp threads 102*b* is equal to or less than 0.4 times the width A of the warp thread 102*b*, that is, $B \leq 0.4$ A, and the thickness D of the weft thread 102*a* is equal to or greater than 0.2 times the width C of the weft thread 102*a*, that is, $D \geq 0.2$ C, the buckling of the weft thread 102*a* is less likely to occur and the occurrence of the wrinkles of the slide sheet 90 is eliminated. In other words, the occurrence of the wrinkles of the slide sheet 90 is avoided when a distance between adjacent spun yarns that are the warp threads 102*b* is equal to or greater than 0.4 times a width of the spun yarn that is the warp thread in a cross-section of the slide sheet 90 illustrated in FIG. 4A seen in the sliding direction of the fixing belt 81 that is the direction of the arrow s in FIG. 3, and a thickness of each spun yarns that are the weft threads 102*a* is equal to or greater than 0.2 times an width of each spun yarn in a cross-section of the slide sheet 90 illustrated in FIG. 4B seen in a longitudinal direction of the slide sheet 90 that is perpendicular to the sliding direction of the slide sheet 90 and the direction of the arrow s in FIG. 3.

In FIG. 5, circle marks ○ mean that the wrinkle did not occur in the slide sheet 90, x marks mean that the wrinkle occurred in the slide sheet 90, and square marks □ mean that a minor wrinkle occurred in the slide sheet 90. FIG. 5 illustrates that the wrinkle did not occur in a range indicated by a thick frame in the upper left of FIG. 5, that is the range of $B/A \leq 0.4$ and $D/C \geq 0.2$. Therefore, the relation between A, B, C, and D as described above is effective in preventing wrinkles.

In addition, as illustrated in FIGS. 4A and 4B, the surface layer 103 made of a material different from that of the base material layer 102 may be provided on the slide surface of the slide sheet 90 with the fixing belt 81. Overlaying the surface layer 103 on the base material layer 102 increases the rigidity of the slide sheet 90 and improves the effect of preventing wrinkles. Use of the surface layer 103 with small sliding resistance such as a PTFE layer reduces friction with the fixing belt 81, and the inner peripheral surface of the fixing belt 81 and the slide surface of the slide sheet 90 become slippery, which decreases the force for buckling the slide sheet 90.

Although the slide sheet 90 in the present embodiment includes three layers, the base material layer 102, the surface layer 103, and the back layer 104, but, when at least one of the surface layer 103 and the back layer 104 are made of resin with high releasability such as PTFE, the base material layer 102 may be impregnated with the resin of the same type as the surface layer 103 or the back layer 104 in order to increase the affinity to the base material layer 102. Such a configuration leads the rigidity of the slide sheet 90 greater than the configuration in which the base material layer 102 is used alone. Additionally, when the surface layer 103 is used, use of the resin described above increases an adhesive strength of the surface layer 103 and the base material layer 102.

In the present embodiment, the spun yarn of the base material layer 102 is made of glass fiber. Since glass fiber is high in heat resistance and high in strength, the grass fiber does not deform even when heat or external force is applied, and the original posture of the slide sheet 90 is easily maintained.

However, the material of the base material layer 102 is not limited to glass fiber, and the spun yarn of the base material layer 102 may be made of, for example, fluororesin fiber such as PTFE or PFA, metal fiber, or the like. Thus, according to required material properties, fibers having flexibility to such an extent that they can be woven can be appropriately used. Although the heat resistance of the resin fiber and metal fiber is lower than that of the glass fiber, high elasticity and flexibility of the resin fiber and metal fiber gives the slide sheet 90 which can easily follow the complicated nip shape.

Figure 6:
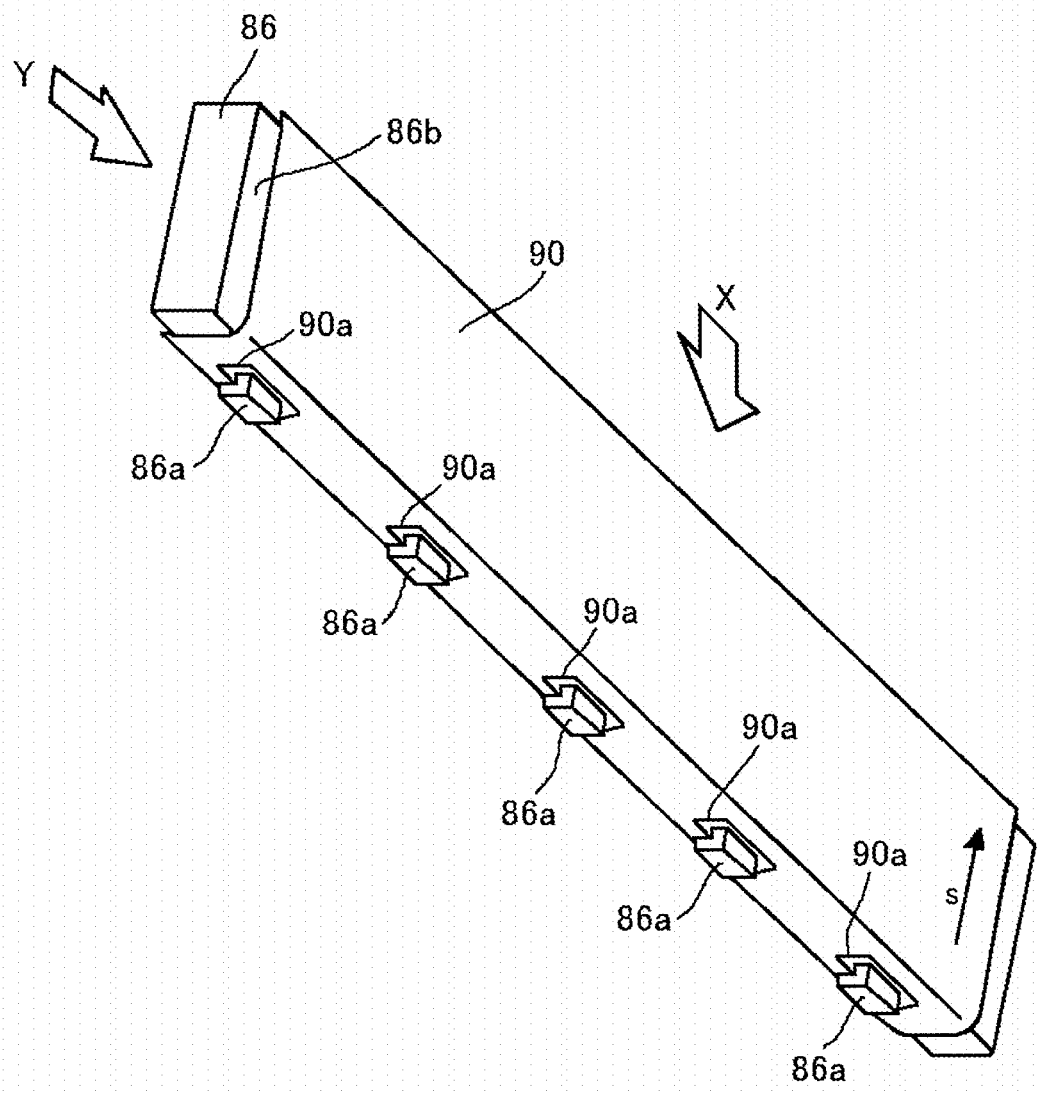
FIG. 6 is a schematic perspective view illustrating a slide sheet according to a second embodiment.
Figure 7A:
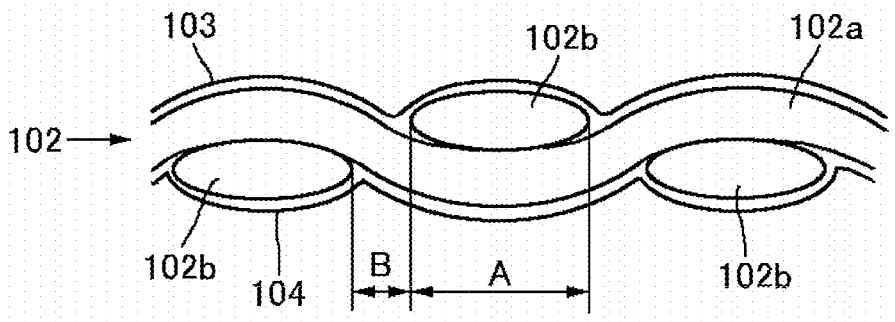
FIGS. 7A and 7B are schematic cross-sectional views illustrating a slide sheet according to a second embodiment.
Figure 7B:
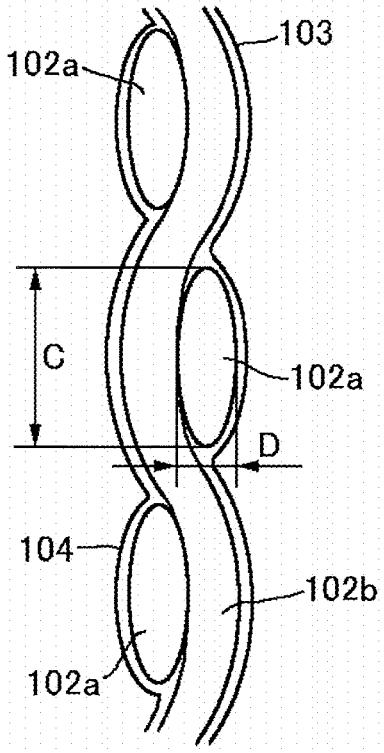

FIG. 6 is a schematic perspective view illustrating a slide sheet according to a second embodiment. FIG. 7A is a schematic cross-sectional view of the slide sheet as viewed in the direction of arrow X in FIG. 6, and FIG. 7B is a schematic cross-sectional view of the slide sheet as viewed in the direction of arrow Y in FIG. 6.

The slide sheet 90 includes a base material layer 102 formed by braiding a weft thread 102*a* and a warp thread 102*b*, a surface layer 103 made of a material such as PTFE to reduce sliding friction, and a back layer 104 disposed to reinforce the slide sheet 90 and prevent the slide sheet 90 from warping. The base material layer 102 of the slide sheet 90 is a sheet-like base material layer made of a woven fabric, and in particular, a base material layer formed by weaving a spun yarn obtained by spinning fibers without knitting. Using the spun yarn instead of a knitting yarn forms a high-density, high-strength base material layer 102, and wrinkles are less likely to occur.

The spun yarn used for the base material layer 102 is not limited to the one obtained by spinning a plurality of thin fibers, and as illustrated in the present embodiment, a single spun yarn may be a single fiber. A density of inside of the single spun yarn made of the single fiber is higher than that of a spun yarn spun with a plurality of fibers because the single spun yarn made of the single fiber has no space inside the spun yarn. Therefore, the spun yarn made of the single fiber becomes a high rigid yarn. Thus, the slide sheet 90 of the spun yarn made of the single fiber becomes stronger than that of the spun yarn spun with the plurality of fibers.

The inventors conducted experiments according to the second embodiment about various factors B/A and D/C and obtained results similar to the first embodiment. That is, when the distance B between adjacent warp threads 102*b* is equal to or less than 0.4 times the width A of the warp thread 102*b*, that is, $B \leq 0.4\,A$, and the thickness D of the weft thread 102*a* is equal to or greater than 0.2 times the width C of the weft thread 102*a*, that is, $D \geq 0.2\,C$, the buckling of the weft thread 102*a* is less likely to occur and the occurrence of the wrinkles of the slide sheet 90 is eliminated. In other words, the occurrence of the wrinkles of the slide sheet 90 is avoided when a distance between adjacent spun yarns that are the warp threads 102*b* is equal to or greater than 0.4 times a width of the spun yarn that is the warp thread in a cross-section of the slide sheet 90 illustrated in FIG. 7A seen in the sliding direction of the fixing belt 81 that is the direction of the arrow s in FIG. 6, and a thickness of each spun yarns that are the weft threads 102*a* is equal to or greater than 0.2 times an width of each spun yarn in a cross-section of the slide sheet 90 illustrated in FIG. 7B seen in a longitudinal direction of the slide sheet 90 that is perpendicular to the sliding direction of the slide sheet 90 and the direction of the arrow s in FIG. 6.

As described above, setting the distance between the adjacent spun yarns in the base material layer 102 of the slide sheet 90 and the cross-sectional shape of the spun yarn within the range of the predetermined ratio gives the slide sheet 90 enough rigidity to resist the external force that occurs the wrinkles, and the simple configuration described above can effectively reduce the generation of the wrinkles on the slide sheet 90.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a rotatable pressing roller;

a fixing rotator to rotate in contact with the pressing roller;

a nip formation pad disposed inside the fixing rotator to form a nip with pressure from the pressing roller to fix an image on a recording medium; and a slide sheet disposed between the nip formation pad and the fixing rotator, the slide sheet including:

a base material layer made of a woven fabric of spun yarn, wherein a distance between adjacent spun yarns of the base material layer is equal to or less than 0.4 times a width of the spun yarn in a cross-section of the slide sheet in a direction of slide movement of the fixing rotator, and, in a cross-section of the slide sheet in a longitudinal direction of the slide sheet and a direction perpendicular to the slide movement of the fixing rotator, a thickness of the spun yarn is equal to or greater than 0.2 times a width of the spun yarn.

2. The fixing device of claim 1, wherein the spun yarn is made of glass fiber.

3. The fixing device of claim 1, wherein the spun yarn is made of at least one of resin fiber and metal fiber.

4. The fixing device according to claim 1, further comprising a surface layer made of a material different from a material of the base material layer, wherein the surface layer is provided on the base material layer as a slide surface of the slide sheet on which the fixing rotator slides.

5. The fixing device according to claim 1, wherein the base material layer of the slide sheet is impregnated with resin.

6. The fixing device according to claim 1, wherein the spun yarn is a single fiber.

7. The fixing device according to claim 1, wherein the spun yarn includes a plurality of fibers.

8. An image forming apparatus comprising the fixing device according to claim 1.

* * * * *